United States Patent [19]

Dhondt

[11] 4,243,510

[45] * Jan. 6, 1981

[54] SHALE RETORTING PROCESS AND APPARATUS

[75] Inventor: Roland O. Dhondt, Long Beach, Calif.

[73] Assignee: Union Oil Company of California, Brea, Calif.

[ * ] Notice: The portion of the term of this patent subsequent to Jul. 31, 1996, has been disclaimed.

[21] Appl. No.: 23,721

[22] Filed: Mar. 26, 1979

Related U.S. Application Data

[63] Continuation-in-part of Ser. No. 891,280, Mar. 29, 1978, Pat. No. 4,162,960.

[51] Int. Cl.[3] ..... C10G 1/02; C10B 31/02; C10B 49/06; C10B 53/06

[52] U.S. Cl. ..... 208/11 R; 201/28; 201/29; 201/32; 201/36; 201/40; 201/42; 201/43; 202/99; 202/221; 202/262; 414/301

[58] Field of Search ..... 201/3, 4, 28, 29, 32, 201/34, 36, 40, 42, 43; 202/93, 96, 99, 108, 121, 221, 262; 208/11 R; 414/301

[56] References Cited

U.S. PATENT DOCUMENTS

| | | | |
|---|---|---|---|
| 2,640,014 | 5/1953 | Berg | 201/29 |
| 2,640,019 | 5/1953 | Berg | 208/11 R X |
| 2,954,329 | 9/1960 | Dhondt et al. | 202/93 |
| 2,980,592 | 4/1961 | Deering et al. | 201/32 |
| 3,004,898 | 10/1961 | Deering | 201/3 |
| 4,162,960 | 7/1979 | Dhondt | 208/11 R |

*Primary Examiner*—Joseph Scovronek

*Attorney, Agent, or Firm*—Dean Sandford; Daniel R. Farrell

[57] ABSTRACT

Crushed oil shale is segregated into a major portion of relatively large particles and a minor portion of "fines," such as will pass through ⅛-inch screen openings. The large particles are subjected to retorting in an upflowing bed in countercurrent contact with a downflowing hot eduction gas, while the fines are fed onto and controllably transported across the hot planar surface of a free-standing truncated cone of spent shale at the top of the retort.

16 Claims, 3 Drawing Figures

SHALE RETORTING PROCESS AND APPARATUS

RELATED APPLICATION

This is a continuation-in-part of application Ser. No. 891,280, filed Mar. 29, 1978, now U.S. Pat. No. 4,162,960 issued July 31, 1979.

BACKGROUND OF THE INVENTION

In the retorting of crushed oil shale with hot eduction gases, a persistent problem has been that of providing efficient retorting of shale particles varying widely in size. Commonly applied shale crushing techniques are controlled to produce a consist containing no particles larger than a permissible maximum, usually about 2 to 4 inches in diameter. Such crushing also inherently produces from about 2 to 15 weight percent of shale "fines" having a diameter of less than about ¼ inch. If this entire consist is utilized in the most prevalent of retorting methods, i.e. countercurrent flow of hot retorting gas through a compact moving bed of the shale particles, serious problems arise. Among these problems are high gas pressure drop through the bed, uneven distribution of gas flow in the bed and increased solids content in the product oil.

To avoid these problems, it has become customary in the art to screen out the fines from the retort feed, and either subject them to separate retorting, or discard them. It would obviously be economically attractive to provide some means for integrating the retorting of shale fines with the retorting of the main body of shale, if the aforementioned problems could be avoided.

U.S. Pat. No. 3,004,898 discloses a solids-upflow, gas-downflow retorting system in which raw shale fines of 0 to ½ inch in diameter, and amounting to about 20 weight percent of the total shale feed, are subjected to separate retorting in concurrent flow with eduction gas, while a very minor proportion of shale fines in the micron size range recovered as a concentrated sludge in the product oil is introduced onto the surface of the spent shale at the top of the retort, where the oil content of the sludge is vaporized and the remaining "micro"-fines are instantaneously retorted. A scraper at the top of the retort continuously scrapes spent shale from the retort maintaining a flat upper surface thereof. Agitation provided by the scraper specifically disclosed in said patent tends to increase the downward infiltration of micro-particles of spent shale to increase bed pressure drop and contaminate the product oil.

My copending application Ser. No. 891,280 discloses a retorting method and apparatus in which the upwardly flowing shale is allowed to form a free-standing cone above the top edge of the retort vessel, and raw shale fines are distributed on the sloping surface of the cone of shale, at or near the apex of the cone. The residence time available for retorting of the raw shale fines is determined by the rate of free gravitation of shale down the side of the cone. Due to the expected variance in size distribution of the raw shale fines from time to time in a commercial-scale retorting operation, this residence time may not always be the optimum. Accordingly it is desirable to have a retorting apparatus and method which allows for the independent control of the raw shale fines residence time in the retort.

SUMMARY OF THE INVENTION

Briefly, this invention provides a method and apparatus for integrating the retorting of relatively large raw shale particles and raw shale fines in which the large particles are pumped upwardly through a retort, countercurrent to a preheated downflowing eduction gas, and the spent shale above the top of the retort is allowed to form a free-standing cone, the apex of which is truncated to form a hot planar surface. The raw shale fines are fed onto the hot planar surface of the truncated cone and are controllably transported across this planar surface to the sloping surface of the truncated cone where the spent shale is permitted to freely gravitate over the top edge of the retort vessel. Preferably the free-standing cone is truncated by rotation of a spiral blade in contact therewith and the rotational speed of the spiral blade is adjusted to control the residence time of the raw shale fines on the planar surface so as to allow substantially complete retorting of the raw shale fines.

BRIEF DESCRIPTION OF THE DRAWINGS

The invention will be more readily understood by reference to the drawings, wherein like numerals refer to like elements, in which.

DETAILED DESCRIPTION OF THE INVENTION

Figure 1:
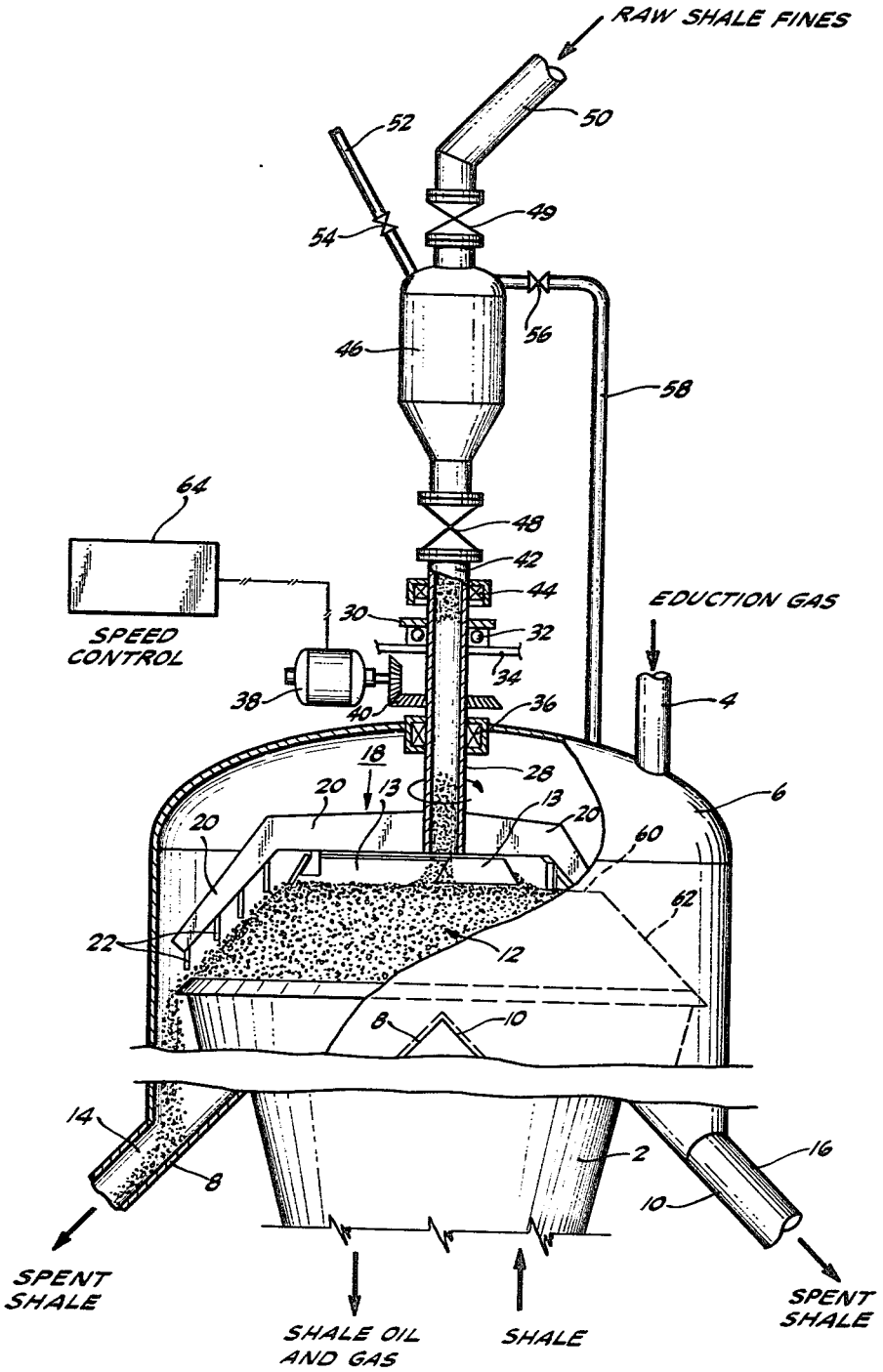
FIG. 1 is an elevational view, partly in vertical diametric cross-section, illustrating one embodiment of the retorting apparatus of this invention.

The characteristics of raw oil shales are generally well known and hence need not be described in detail. For practical purposes, however, the shale should contain at least 10, preferably at least about 20 and usually between about 25 and 75 gallons of oil per ton by Fischer assay. The shale is crushed by conventional means to produce a raw shale consist having no particles greater than about 4 inches, and preferably none greater than about 2½ inches in diameter. (Shale particle "diameters" herein refer to the smallest size of screen opening through which particles of the designated "diameter" will pass.) Particle size ranges for the upflow feed to the retort are as follows:

| | Particle Diameter, inches | | |
|---|---|---|---|
| | Maximum | Preferred | Minimum |
| Largest Particles | 4 | 1½ to 2½ | 1 |
| Smallest Particles | ¼ | 1/10 to 3/16 | 1/16 |
| Particle size ranges for the shale fines are as follows: | | | |
| Largest Particles | ¼ | 1/10 to 3/16 | >0 |
| Smallest Particles | ⅛ | 1/10 to ⅛ | >0 |

In order to avoid undue infiltration of shale fines downwardly into the shale bed, it is further preferred that at least about 25 percent, and still more preferably at least about 50 percent by weight of the raw shale fines fed into the top of the retort should be made up of particles of diameter greater than 1/16 inch.

Screening to produce the desired shale feeds is carried out in conventional fashion and the resulting recovery of 0 to ¼ inch fines usually amounts to about 3 to 15 weight percent of the total, and of 0 to ⅛ inch fines about 2 to 10 weight percent.

In the process of this invention, the maximum proportion of fines which can be successfully retorted without appreciable disruption of gas flow patterns, temperature profiles and pressure drop characteristics is about 15 weight percent, and usually about 10 weight percent, based on total feed to the retort.

Reference is now made to the drawings which illustrate a preferred mode of fines handling and retorting. Retort 2 may be a conventional frusto-conical structure of the type described in U.S. Pat. No. 3,361,644, which patent also described a suitable feeder mechanism at the lower end thereof for pumping the main body of crushed shale upwardly through the retort. An oxygen-free education gas, preheated to about 900° to 1150° F., is admitted via inlet conduit 4, affixed to shroud 6, which in turn is affixed in fluid-tight fashion to the outer wall of the retort by means of bilaterally sloping floors 8 and 10, welded to the sides of the retort and the lower extremity of shroud 6.

As the shale progresses upwardly through the retort its temperature is gradually increased to eduction levels by the downflowing eduction gas, which is preferably a recycled portion of make gas from the retort, consisting mainly of $H_2$, $CH_4$, $C_2$–$C_5$ hydrocarbons and $CO_2$. Suitable flow rates for gases of this nature generally range between about 10 and about 15 MSCF per ton of total shale feed; the total heat input for successful retorting herein ranges between about 350,000 and 450,000 BTU's per ton of shale. The total heat input is controlled, as by adjusting the temperature and/or flow rate of the eduction gas to achieve the desired yield of product gas and oil from the upflowing shale plus the shale fines. Retorting pressures (at the top of the retort) range between about 5 and 400 psig, preferably about 10 and about 50 psig. Generally, the upflowing shale residence time in the retort is about 20 minutes to 2 hours. The educed product oil and gases flow downwardly through the shale bed and are recovered at the bottom of the retort as described in U.S. Pat. No. 3,361,644.

The spent shale is allowed to form a free-standing truncated cone 12 at the top of retort 2. As described more fully hereinbelow, spiral blade 13 truncates cone 12 and transports spent shale across the substantially horizontal, hot planar surface 60 of cone 12 from the central portion of cone 12 radially outwardly to the sloping surface 62 of cone 12. Sloping surface 62 of cone 12 is usually defined by an angle of repose of the shale particles of about 35° to 45° from horizontal. Spent shale slides by gravity down sloping surface 62 and falls over the edge of the retort onto sloping floors 8 and 10, and is removed via outlet conduits 14 and 16, which are sealed by conventional means, not shown, to prevent the escape of gases therethrough.

Figure 2:
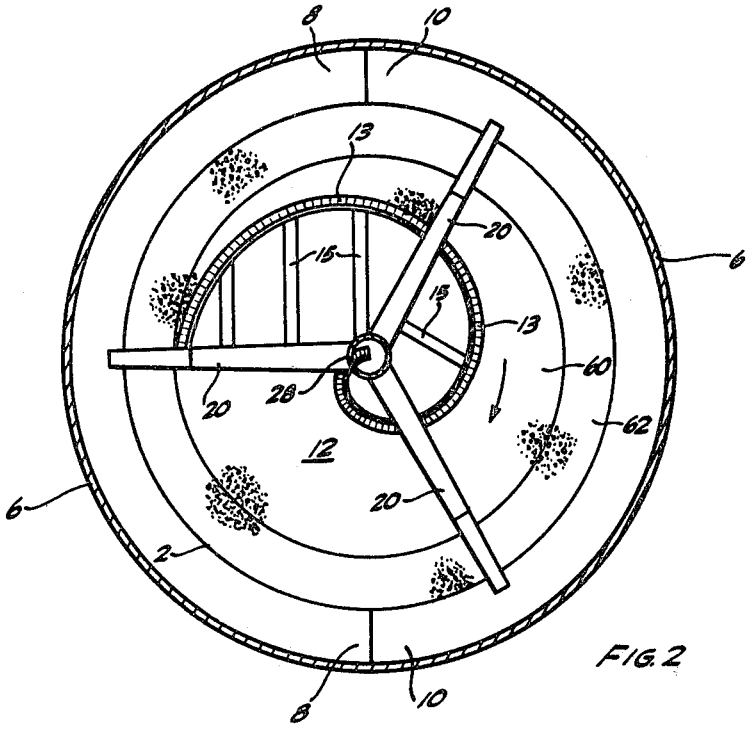
FIG. 2 is a plan view illustrating the rake arms and spiral blade of the retorting apparatus illustrated in FIG. 1.

FIG. 1 illustrates a preferred embodiment of the raw shale fines feeding and transporting system, indicated generally as 18. System 18 includes (1) fines delivery conduit 28 which is supprted above and has a common axis with truncated cone 12 and retort 2, (2) one or more, preferably three, rake arms 20 which are supported by and extend radially outwardly from conduit 28 so as to be substantially parallel to planar surface 60 and sloping surface 62 of truncated cone 12, and (3) spiral blade 13 which is fixedly attached to and supported from rake arms 20 and the lower end of delivery conduit 28. Conduit 28 serves as a drive shaft for rotation of rake arms 20 and spiral blade 13. Spiral blade 13 contacts planar surface 60 and is adapted, upon rotation thereof, to transport the upwardly flowing spent shale from the central portion of planar surface 60 radially outwardly to sloping surface 62. As best seen in FIG. 2, spiral blade 13 is in the form of a spiral of 360° or less which is uniformly increasing in radius from conduit 28 outwardly to the perimeter of planar surface 60. Preferably spiral blade 13 is in the form of an Archimedean spiral because the force exerted on the spent shale by rotation of an Archimedean spiral is substantially exclusively radially directed and the circumferentially directed forces are minimized, thereby reducing the abrasion of the spent shale to a practical minimum. As shown in the drawings, the leading surface of spiral blade 13 is preferably inclined at an angle between about 10° and about 60° from vertical in order that spiral blade tends to lift the spent shale being transported during rotation of blade 13, which lifting also tends to minimize shale abrasion.

Figure 3:
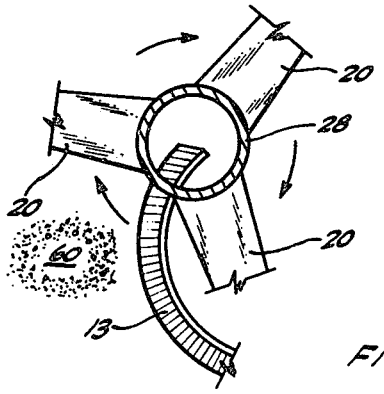
FIG. 3 is an enlarged partial plan view illustrating the connection of the spiral blade to the rake assembly.

Referring to FIG. 2, spiral blade 13 is fixedly attached to and supported from rake arms 20 and delivery conduit 28, and a plurality of support elements 15 are provided, if required, to support the sections of spiral blade 13 which are relatively remote from rake arms 20. FIG. 3 illustrates the preferred spacial relationship of delivery conduit 28 and spiral blade 13 in which the raw shale fines are fed onto planar surface 60 at a point just ahead of the inclined leading surface of spiral blade 13.

In the modification illustrated, rake arms 20 extend substantially to the rim of the retort in order that they may perform a raking action to break up any large spent shale agglomerates which may occasionally form and disrupt normal solids and gas flow. For this purpose a series of downwardly extending teeth 22 are provided, affixed to and depending from the underside of arms 20 and extending downwardly to about 2 to 8 inches above the normal surface of cone 12. Thus, in normal operation, teeth 22 do not contact the surface of the spent shale. Such contact is undesirable because it tends to cause crumbling of the friable spent shale and promotes the downward sweep of micro-fines by the downflowing eduction gas, resulting in increased bed pressure drop and contamination of product oil.

Rake arms 20 are affixed at their inward extremity to rotating fines-delivery conduit 28, which is supported by means of flange 30 on bearings 32 and structural support element 34. A pressure-retaining seal at the point of entry of conduit 28 into the retorting zone is provided in the form of packing gland 36. Motive power for rotation of the entire fines feeding and transporting system is provided by means of motor 38 and bevel gears 40. Conventional speed controller 64 is provided to adjust motor 38 in order to vary the rotational speed of conduit 28. The upper extremity of rotating conduit 28 communicates with the bottom of stationary delivery conduit 42 via pressure retaining packing gland 44.

In order to transfer shale fines from atmospheric storage to the pressurized retort system, a conventional lock vessel 46 is provided, communicating via valve 48 with stationary conduit 42, and via valve 49 with shale supply conduit 50. A gas vent line 52 controlled by valve 54 is provided to depressure vessel 46 (valve 48 closed) prior to opening valve 49 for charging vessel 46 with shale fines. With a fresh shale charge in place, valves 54 and 49 are closed and valve 56 in pressure equalizing conduit 58 is opened in order to equalize pressures in vessel 46 and the retorting zone. Valve 48 can then be opened to deliver the shale charges to the distribution system. It will be understood that the operation of valves 48, 49, 54 and 56 can readily be controlled by conventional automatic cycle timer means.

As an alternative to the above intermittent shale fines transfer system, lock vessel 46 and valve 48 can be replaced with a conventional star feeder adapted to provide a continuous transfer of fines from low-pressure supply conduit 50 to pressurized stationary conduit 44.

In the method of this invention, the raw shale fines are dumped continuously or intermittently on or near the center of planar surface 60 of truncated cone 12, and the rotational speed of spiral blade 13 is controlled, in accordance with the size of the raw shale fines, in order to provide sufficient residence time on planar surface 60 for substantially complete retorting of the raw shale fines. Fines having a diameter of ⅛" or less can be completely retorted in less than about one minute. Conversely, fines having a diameter up to about ¼" may require up to about 3 minutes. In general, for particles ranging up to about ¼" in size, it is seldom necessary to provide a residence time of more than about 5 minutes, usually about 0.5 to about 3 minutes.

The rotational speed of spiral blade 13 is adjusted to control the residence time of the raw shale fines on planar surface 60. Often there is a minimum rotational speed required in order that spiral blade 13 does not inhibit the movement of the upwardly moving bed of larger shale particles, and the maximum rotational speed is determined by the residence time required for substantially complete retorting of the raw shale fines. Subject to the above-described minimum and maximum limits, suitable rotational speeds are between about 0.1 and about 10 revolutions per minute, preferably between about 0.3 and about 3 revolutions per minute. By monitoring the size distribution of the raw shale fines to be introduced into the retort via conduit 28, the rotational speed of spiral blade 13 may be adjusted to control the desired residence time. As such the method and apparatus of this invention are more adaptable for handling varying fines consists than the method and apparatus disclosed in my application Ser. No. 891,280.

EXAMPLE

An exemplary set of operating conditions for the retorting of 10,000 tons/day of ½ to 2 inch crushed shale having a Fischer assay of 41 gallons per ton and about 580 tons per day of 0 to ⅛ inch shale fines fed onto and transported across the truncated cone of spent shale as illustrated in the drawings is as follows:

Retort pressure, psig: 10
Eduction gas temp., °F.: 1,000
Eduction gas rate, SCF/ton of total shale: 13,800
Rotational Speed of Spiral Blade, rpm: 1
Eduction gas composition, Vol. %
$H_2$: 22.0
$CH_4$: 21.0
$CO_2$: 16.8
$H_2O$: 7.4
CO: 4.6
$H_2S$: 5.2
$C_2$–$C_5$: 20.6

Under these conditions the yield of net make gas having the same composition as the above eduction gas is about 1017 standard cubic feet per ton of shale, and the yield of total liquid product is about 298 pounds per ton of shale. This gas yield is slightly higher and the liquid yield is slightly lower than the respective yields obtained by the upflow retorting of 10,500 tons/day of ⅛ to 2 inch shale under the same conditions with no added fines, but overall hydrocarbon yields are approximately the same.

The following claims and their obvious equivalents are believed to define the true scope of the invention.

I claim:

1. In a shale retorting process wherein a bed of granular crushed oil shale substantially free of particles having a diameter less than about 1/16 inch and above about 4 inches is passed upwardly through a retort, countercurrently to a preheated downflowing oxygen-free eduction gas to educe product oil and gas therefrom, and wherein spent shale is allowed to overflow by gravity from the top perimeter of said retort thereby forming the bottom portion of a free-standing cone-shaped bed of spent shale extending above the top of said retort through which said preheated downflowing eduction gas passes, the improved method for retorting raw crushed oil shale fines substantially free of particles having a diameter greater than about ¼ inch which comprises:

(a) leveling the top of said free-standing bed so as to form a free-standing truncated cone extending above the top of said retort and having a substantially horizontal, planar top surface and a cone-like inwardly sloping surface;

(b) feeding said raw shale fines onto said planar surface and controllably transporting said fines in a generally radial direction across said planar surface to said sloping surface, said raw shale fines beng fed at a rate no greater than about 15 weight percent of the total raw shale including fines being fed to said retort; and (c) controlling the flow rate and temperature of said eduction gas so as to produce product gas and oil from said granular oil shale and said raw shale fines.

2. The method defined in claim 1 wherein the rate of transporting said fines across said planar surface is controlled at a rate selected to provide sufficient residence time on said planar surface for substantially complete retorting of said raw shale fines.

3. The method defined in claim 2 wherein said rate of transportation provides an average residence time on said planar surface between about 0.5 and about 5 minutes.

4. The method defined in claim 1 further comprising the step of adjusting the rate of transporting said fines across said planar surface in accordance with the size of said raw shale fines so as to provide sufficient residence time on said planar surface for substantially complete retorting of said raw shale fines.

5. The method defined in claim 1 wherein said leveling and transporting are done by substantially continuously rotating a blade about the axis of said retort in contact with the top surface of said free-standing cone.

6. The method defined in claim 5 wherein said blade is a spiral blade which, upon rotation, exerts a radially directed force upon the spent shale being transported across said planar surface.

7. The method defined in claim 5 wherein said blade is rotated at a selected speed of between about 0.1 and about 10 revolutions per minute, said speed being selected so as to provide sufficient residence time of said fines on said planar surface for substantially complete retorting of said raw shale fines.

8. The method defined in claim 1 wherein said raw shale fines contain at least about 25 weight percent of particles having a diameter greater than 1/16 inch.

9. The method defined in claim 1 wherein said bed of crushed oil shale is substantially free of particles having a diameter less than about 1/10 inch and greater than about 2½ inches.

10. The method defined in claim 1 wherein said shale fines are substantially free of particles having a diameter above about 3/16 inch.

11. The method defined in claim 1 wherein the largest particles in said bed of crushed oil shale have a diameter between about 1½ and 2½ inches, the smallest particles in said bed have a diameter between about 1/10 and 3/16 inch, and wherein the largest particles in said shale fines have a diameter between about 1/10 and 3/16 inch, at least 25 percent by weight of said fines being particles having a diameter greater than 1/16 inch.

12. A shale retorting apparatus comprising:

a frusto-conical retort vessel adapted to receive upflowing crushed shale and to discharge spent shale over the top perimeter thereof;

a fluid-tight shroud enclosing the upper portion of said retort vessel and affixed thereto by means of a sloping floor below the top perimeter of said retort vessel, said sloping floor being adapted to receive spent shale discharged from said retort vessel and to transmit the same by gravity flow to one or more spent shale discharge conduits;

a shale fines delivery conduit vertically and rotatably mounted above said shroud, and extending via a fluid-tight seal through the central portion of the roof of said shroud, and terminating in an open end spaced above the top center of said retort vessel, said delivery conduit being adapted at a point above said shroud to receive raw shale fines and being adapted to discharge said raw shale fines through said open end;

at least one rake arm rigidly affixed to the lower end of said delivery conduit and extending radially outwardly therefrom a substantial distance;

transport means rigidly affixed to and suspended from said open end of said delivery conduit, said transport means being positioned relative to said retort vessel so as to contact the top planar surface of a free-standing truncated cone of shale particles in said retort vessel and being adapted for rotation with said delivery conduit so as to transport shale particles across said planar surface from the axis of said truncated cone radially outwardly to the sloping surface of said truncated cone;

motive means for rotating said delivery conduit;

pressure-sealed means communicating with the top of said delivery conduit for the gravity feed of shale fines thereto; and conduit means mounted on said shroud for delivering preheated eduction gas through said shroud for passage downwardly through said retort vessel.

13. The apparatus defined in claim 12 wherein said transport means is a spiral blade having a uniformly increasing radius from its axis of rotation outwardly to the perimeter of said planar surface.

14. The apparatus defined in claim 13 wherein said spiral blade has an inclined leading surface adapted for lifting shale particles as the shale particles are being transported across said planar surface.

15. The aparatus defined in claim 12 further comprising control means for controlling the speed of rotation of said delivery conduit and said transport means.

16. The apparatus defined in claim 12 further comprising a plurality of downwardly extending scraper teeth affixed to the undersurface of said rake arm, and adapted to break up large aggregates of spent shale discharging from said retort vessel.

* * * * *

UNITED STATES PATENT AND TRADEMARK OFFICE

CERTIFICATE OF CORRECTION

PATENT NO. : 4,243,510

DATED : January 6, 1981

INVENTOR(S) : ROLAND O. DHONDT

It is certified that error appears in the above-identified patent and that said Letters Patent are hereby corrected as shown below:

In column 7, claim 11, line 13, insert the word --about-- after "least".

Signed and Sealed this

*Twenty-first* Day of *April 1981*

[SEAL]

*Attest:*

RENE D. TEGTMEYER

*Attesting Officer*

*Acting Commissioner of Patents and Trademarks*